US005585609A

United States Patent [19]

Ferree

[11] Patent Number: 5,585,609

[45] Date of Patent: Dec. 17, 1996

[54] CIRCUIT BREAKER WITH MOVABLE MAIN CONTACT MULTI-FORCE-LEVEL BIASING ELEMENT

[75] Inventor: James E. Ferree, Lawrenceville, Ga.

[73] Assignee: Siemens Energy & Automation, Inc., Alpharetta, Ga.

[21] Appl. No.: 314,467

[22] Filed: Sep. 28, 1994

[51] Int. Cl.[6] ..... H01H 75/00

[52] U.S. Cl. ..... 218/22; 335/16; 218/32

[58] Field of Search ..... 218/1, 2, 8, 16, 218/17, 18, 19, 20, 21, 22, 23, 26, 27, 30, 31, 32, 33, 146; 335/15, 16, 38, 42, 165, 174, 195, 202, 172, 189, 147, 192, 193, 194, 196, 200, 203

[56] References Cited

U.S. PATENT DOCUMENTS 4,594,567 6/1986 DiMarco et al. ..... 335/16
4,595,896 6/1986 DiMarco et al. ..... 335/202
4,680,564 7/1987 DiMarco et al. ..... 335/16
4,695,690 9/1987 Banfi ..... 200/147 R
5,164,560 11/1992 Uchida et al. ..... 200/147 R
5,184,099 2/1993 DiMarco et al. ..... 335/16

*Primary Examiner*—Brian W. Brown
*Assistant Examiner*—Michael A. Friedhofer

[57] ABSTRACT

A circuit breaker including a base having an operating mechanism mounted thereon, a line contact blade assembly coupled to the operating mechanism for movement between open and closed positions, and a load contact blade assembly pivotally supported by a terminal strap for movement between an open and closed position with respect to the line contact blade is disclosed herein. A load blade return spring is positioned to bias the load contact blade assembly into engagement with the line contact blade. Furthermore, a multi-force spring device is disposed to apply a first force to the load contact blade while the load contact blade is in the closed position and a second force to the load contact blade in the blow open position, wherein the first force is greater than the second force.

20 Claims, 4 Drawing Sheets

FIG. 3
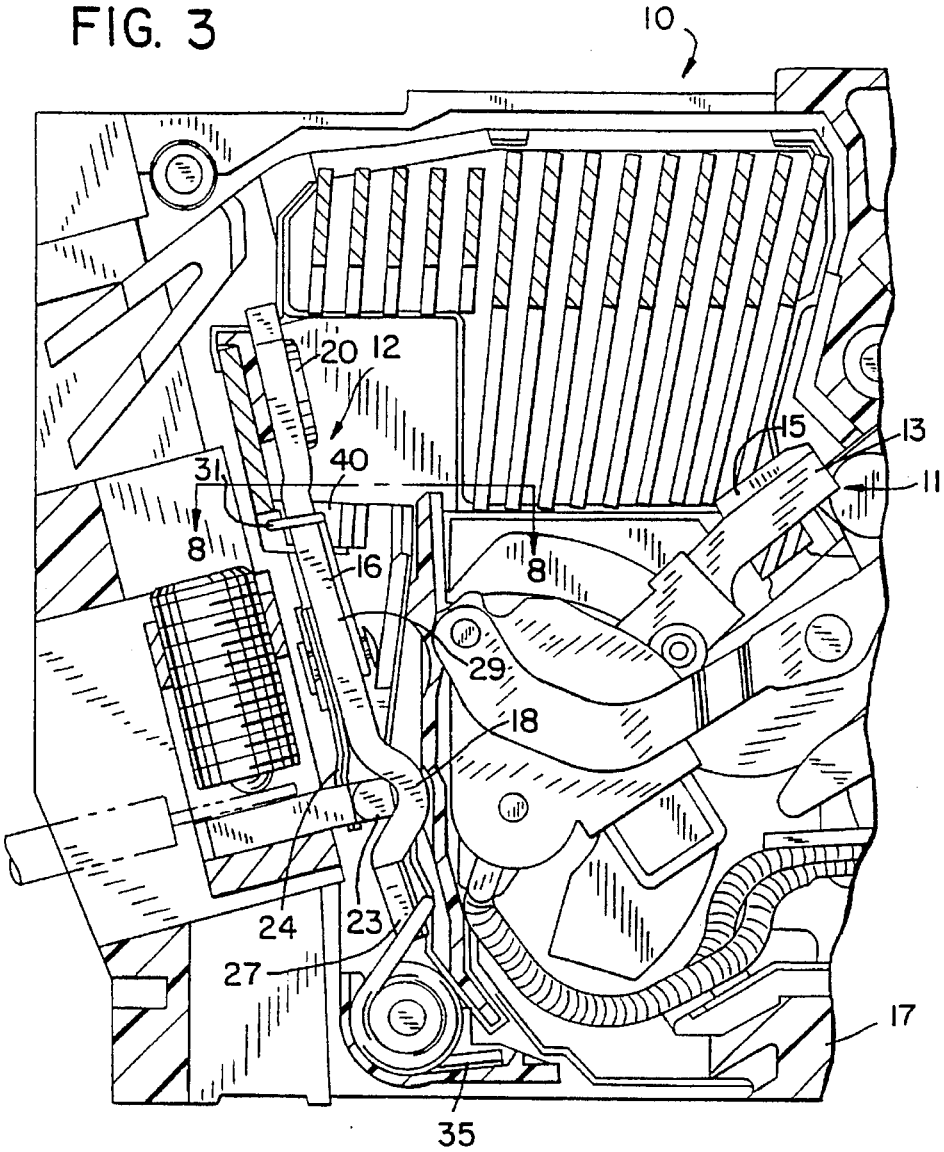
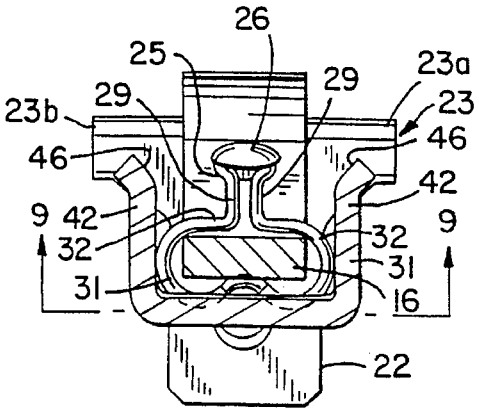
FIG. 8
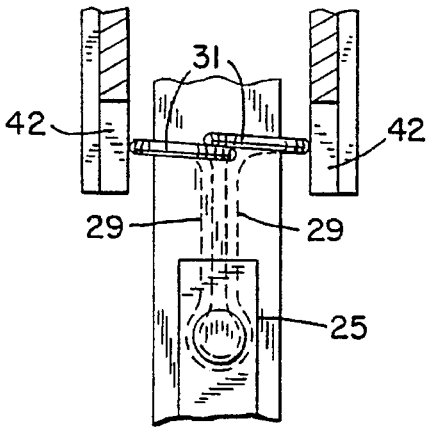
FIG. 9

CIRCUIT BREAKER WITH MOVABLE MAIN CONTACT MULTI-FORCE-LEVEL BIASING ELEMENT

FIELD OF THE INVENTION

The present invention relates to a circuit breaker having dual moveable contact blades and more particularly to a moveable load contact blade assembly and an assembly for controlling the movement of the load contact blade.

BACKGROUND OF THE INVENTION

Typical multi-pole circuit breakers have a common cross bar member for operation of all poles of a multi-pole circuit breaker simultaneously. Typical circuit breakers of the type contemplated herein are shown and described in U.S. Pat. No. 4,594,567, entitled "Circuit Breaker Contact Arm Assembly Having A Magnetic Carrier," issued on Jun. 10, 1986; U.S. Pat. No. 4,680,564, entitled "Multi-Pole Molded Case Circuit Breaker With A Common Contact Operating Crossbar Member," issued on Jul. 14, 1987, and U.S. Pat. No. 4,595,896, entitled "Molded Case Circuit Breaker Having A Reinforced Housing," issued on Jun. 17, 1986, each of which has a fixed load contact arm.

A dual movable contact circuit breaker is shown and described in U.S. Pat. No. 5,184,099, entitled "Circuit Breaker With Dual Movable Contacts," issued on Feb. 2, 1993, which includes a pivotally semi-stationary load contact arm and line contact arm. The load contact arm is semi-stationary because it only moves under high current blow-apart conditions. The load contact arm and line contact arm separate in response to a high level current sufficient to blow the arms apart. The load contact arm is subjected to a reduced upward force after the arm has moved downward from its operating position. This is achieved by an arrangement which includes a set of springs which bias the load contact arm toward its operating position with the different levels of force. The first level of force is greater than the second level of force, and holds the load contact arm in its operating position against the downward force applied through the contacts from the line contact arm to the load contact arm. The second level of force allows the load contact arm to move downward with reduced force when the arms blow apart due to electromagnetic forces. A U-shaped housing magnetically attracts the line contact arm to allow the arms to blow apart more swiftly and to prevent the return of the load contact arm to its operating position until the arc between the arms is extinguished.

While various arrangements are available to provide variable or multi-level support force to contact support arms, it is important to configure such supports to function properly within the associated circuit breaker. Thus, due to the very high competition in the circuit breaker market, it would be desirable to provide a contact arm support device with multi-level support forces, improved performance characteristics and reduced cost.

SUMMARY OF THE PRESENT INVENTION

The present invention provides a circuit breaker including a base, a first contact arm moveable between first and second positions, a second contact arm pivotally supported relative to the base to pivot about an axis when forced from a closed position to an open position and an operating mechanism supported by the base and coupled to one of the contact arms to cause movement thereof. The circuit breaker also includes a first spring cam supported by the base and a spring fastened to the second contact arm. The first spring cam surface includes a first surface substantially perpendicular to the axis and a second surface extending from the first surface at a predetermined angle. The spring engages the first surface when the second contact arm is in the open position and engages the second surface when the second contact arm is in the closed position. With this configuration, the force required to move the contact arm from the closed position to the open position is higher when the spring is in contact with the second surface than when the spring is in contact with the first surface.

Another configuration of the circuit breaker includes a base, a first contact arm moveable between first and second positions, a second contact arm pivotally supported relative to the base to pivot about an axis when forced from a closed position to an open position, an operating mechanism supported by the base and coupled to one of the contact arms to cause movement thereof, and a multi-level force assembly coupled between the base and the second contact arm. The assembly includes a first spring cam surface including a first surface substantially perpendicular to the axis and a second surface extending from the first surface at a predetermined angle, and a spring configured to engage the first surface when the second contact arm is in the open position and engage the second surface when the second contact arm is in the closed position. With this configuration, the force required to move the second contact arm from the closed position to the open position is higher when the spring is in contact with the second surface than when the spring is in contact with the first surface.

The present invention further provides a contact arm biasing assembly for a circuit breaker of the type including a semi-stationary contact arm biased to a closed position and forcible to an open position when rotated about an axis. The assembly includes a camming surface member including a first surface substantially perpendicular to the axis, a second surface substantially perpendicular to the axis, a third surface extending from the first surface at a predetermined angle and a fourth surface extending from the second surface at the predetermined angle. The assembly further includes a spring engaged with the first and second surfaces when the contact arm is in the open position and engaged with the third and fourth surfaces when the contact arm is in the closed position. With this configuration, the force required to move the contact arm from the closed position to the open position is higher when the spring is in contact with the third and fourth surfaces than when the spring is in contact with the first and second surfaces.

BRIEF DESCRIPTION OF THE DRAWINGS

FIG. 3 is a view similar to FIG. 2 showing the contact blades in the blown open position;

FIG. 8 is a view taken on line 8—8 of FIG. 3;

FIG. 9 is a view taken on line 9—9 of FIG. 8; and

DETAILED DESCRIPTION OF THE PREFERRED EMBODIMENTS

Figure 1:
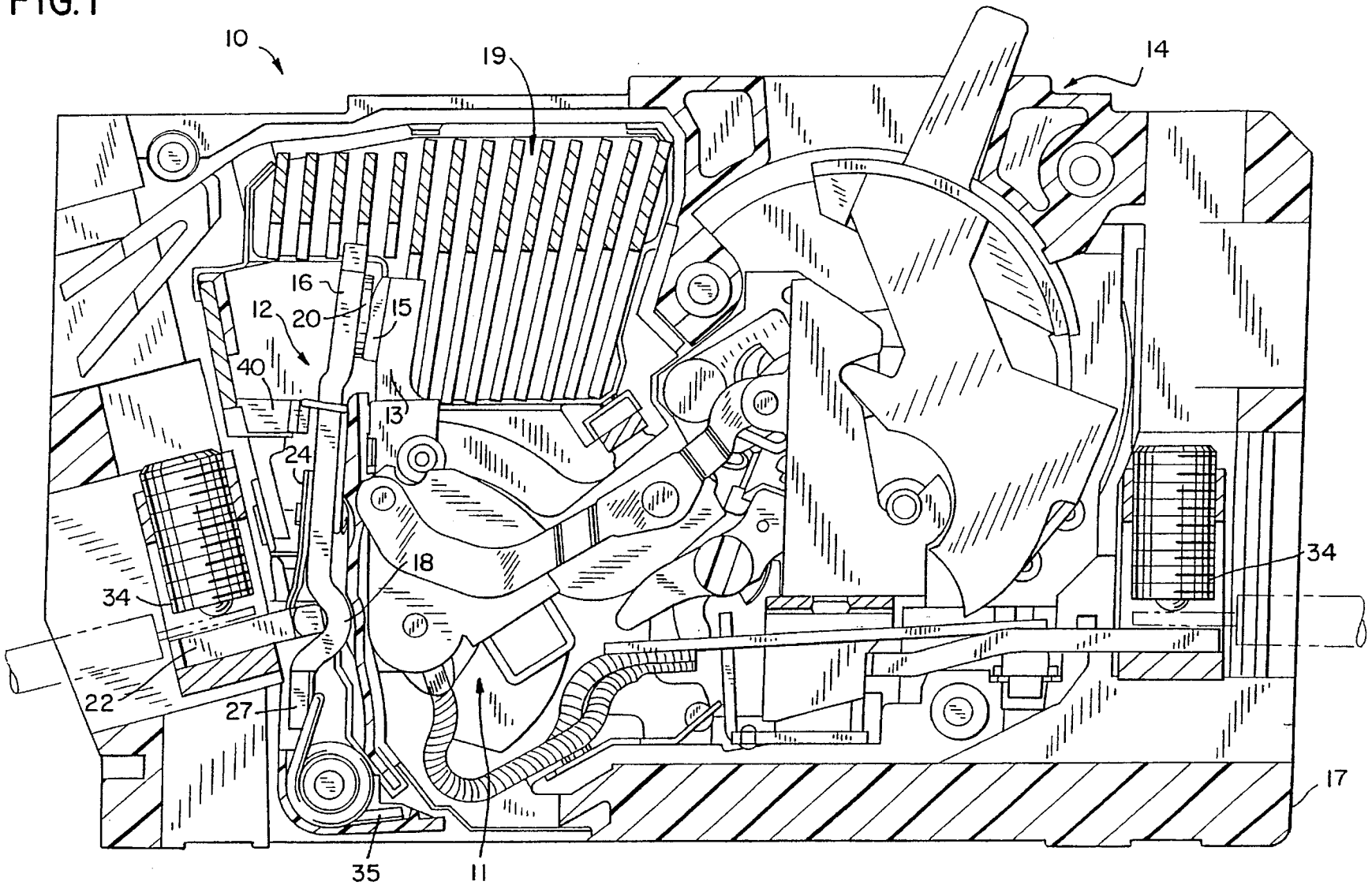
FIG. 1 is a side elevation view, partly broken away, of the molded case circuit breaker according to the present invention with the contact blades shown in the closed position.

Referring to FIG. 1, a circuit breaker 10 includes an enclosure having a base 17, a line contact blade assembly 11, a load contact blade assembly 12, an arc chamber 19 supported by the enclosure above the contact blade assemblies 11 and 12 and a contact operating mechanism 14. The blade assemblies 11 and 12 are pivotally supported by base 17. The line contact blade assembly 11 is shown in the closed position in FIG. 1, and in the open position in FIG. 2. Assemblies 11 and 12 are shown in the blown open position in FIG. 3. Line contact blade assembly 11 generally includes a blade 13 having an electrical contact 15 on the upper end. Blade 13 is pivotally supported by base 17.

Operating mechanism 14 is supported by base 17 and provided for moving blade assembly 11 between open and closed positions with respect to load contact blade assembly 12. Depending upon the application (i.e. single or multi-pole), operating mechanism 14 will interact with a crossbar to move multiple assemblies 11 simultaneously. The present embodiment of circuit breaker 10 includes three poles. However, for purposes of clarity, only a single pole of circuit breaker 10 is described herein. By way of example, operating mechanism 14 can be configured as shown and described in U.S. Pat. No. 4,594,567 noted above.

Figure 2:
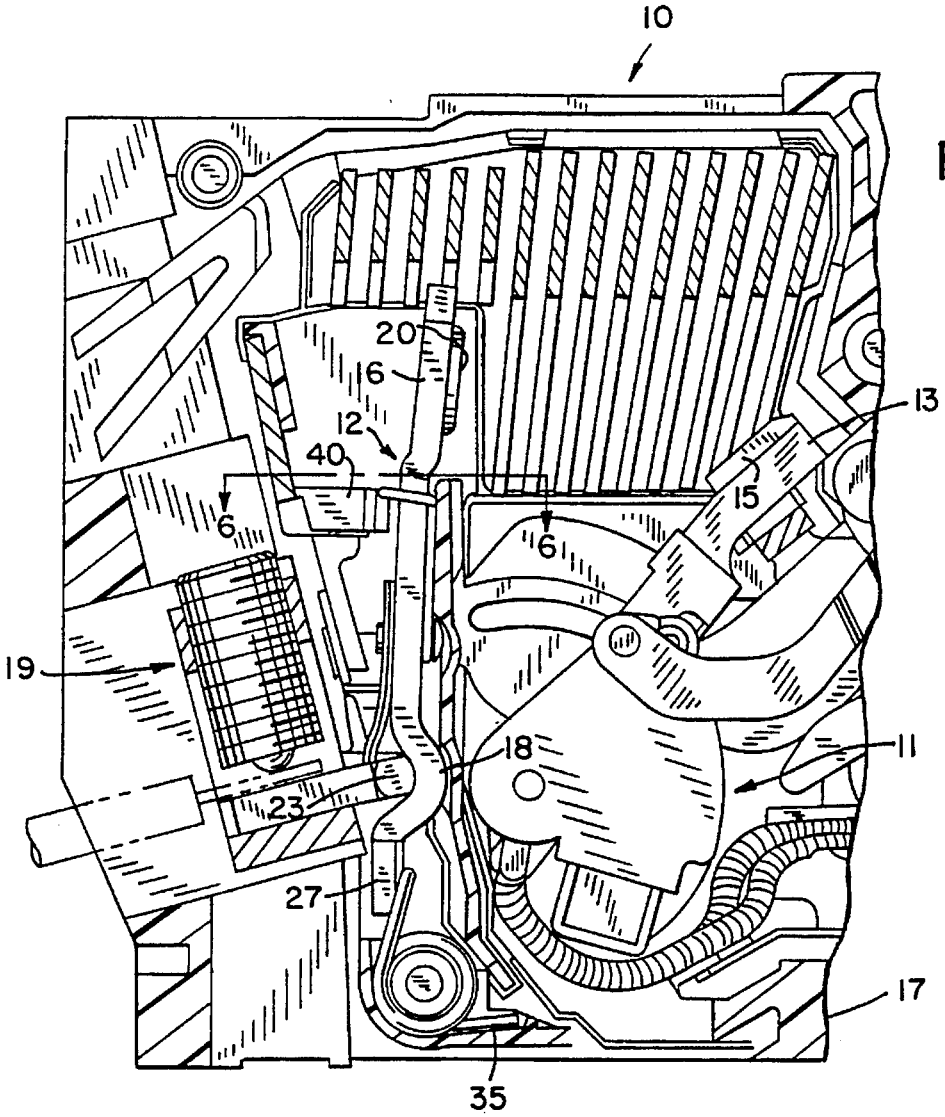
FIG. 2 is a partial view of FIG. 1 showing the contact blades in the open position.

Referring still to FIGS. 1–3, and also to FIGS. 4–9, load contact blade assembly 12 generally includes a blade 16 having V-shaped offset bearing section 18 at the lower end and an electrical contact 20 at the upper end which is positioned to engage electrical contact 15 on line contact blade 13. A terminal strap 22 having a multi-sided (e.g., octagonal) cross piece or shaft 23 which is seated in bearing section 18 and retained therein by a leaf spring 24 which is secured to the blade 16 by a rivet 26. Alternatively, shaft 23 could have a circular cross-section. The lower end of the spring 24 projects into an opening 28 in the terminal strap 22. Strap 22 is pivotally supported at the end bearing portions 23*a* and 23*b* of piece 23 by an appropriate bearing structure in base 17 (e.g. molded recess). For example, portions 23*a* and 23*b* could be captured between base 17 and the top portion of the circuit breaker 10 enclosure when base 17 and the top portion are joined. Thus, strap 22 can pivot about the axis of shaft 23 relative to base 17.

Figure 10:
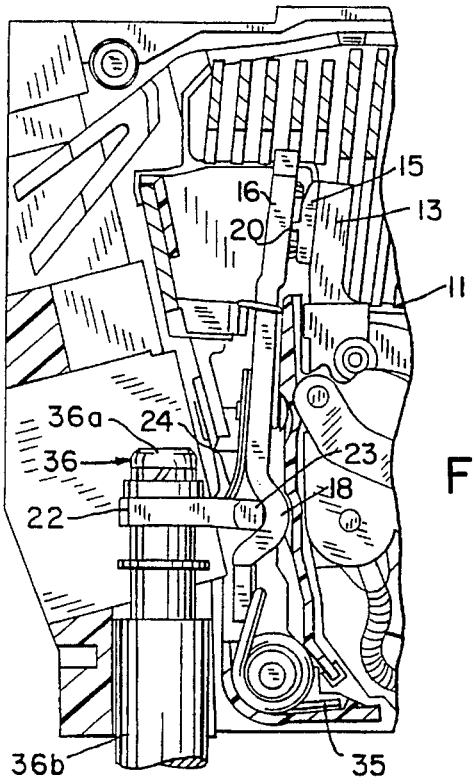
FIG. 10 is a view of an alternate terminal connection arrangement.

A feature of this arrangement is the dual function of terminal strap 22 which allows load contact blade 16 to pivot or rotate generally about the axis of cross piece 23 and allows terminal strap 22 to rotate into a plurality of positions relative to base 17. With this arrangement the terminal strap 22 can be pivoted to engage a clamp-type line connector 34, as shown in FIG. 1, or pivoted to engage a threaded line connector 36, as shown in FIG. 10. Connector 36 includes a threaded fastener 36*a* which passes through an opening in terminal 22 and engages the threads of a threaded wire end 36*b*. The conductor is attached to terminal 22 so the axis of the end portion of the conductor is substantially coincident with the axis of fastener 36*a*.

Load contact blade assembly 12 is pivoted about piece 23 and biased into engagement with the line contact blade assembly 11 by a return spring 35 in the form of a torsion spring which is mounted on base 17 in a position to engage lower end 27 of load contact blade 16.

Another advantage of the present configuration is the provision of V-shaped offset bearing section 18 of load contact blade 16 which makes contact with the cross piece 23 of terminal strap 22. The crosspiece 23 is seated against the angled sides of the V-shaped bearing section 18. This configuration increases the contact forces between the blade 16 and the strap 22. The contact forces with the V-shaped bearing are greater than they would be with, for example, a circular-shaped journal bearing. It is advantageous to increase these contact forces for two reasons. First, because electrical current is conducted through this bearing, the increased contact forces tend to reduce the resistance to electrical current flow through the bearing surfaces. Accordingly, by reducing electrical resistance, this also reduces the amount of heat produced in the bearing. Second, it is important to have sufficiently high contact forces in order to counteract the effects of current constriction forces in the bearing interface. Typically, when two electrical conductors make physical contact with each other, and an electrical current flows from one conductor into the other through the contact interface, an electrodynamic repulsion force, due to the phenomenon of current constriction, arises between the two parts which tends to separate them. In the bearing surface between the load contact blade 16 and the terminal strap 22, such separation would be undesirable because it would result in an electric arc which would damage the bearing surfaces. The increased contact forces of the present configuration help to prevent separation from occurring.

Figure 6:
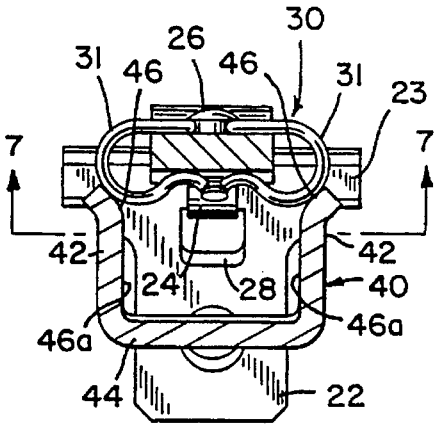
FIG. 6 is a view taken on line 6—6 of FIG. 2 showing the contact pressure spring assembly.
Figure 7:
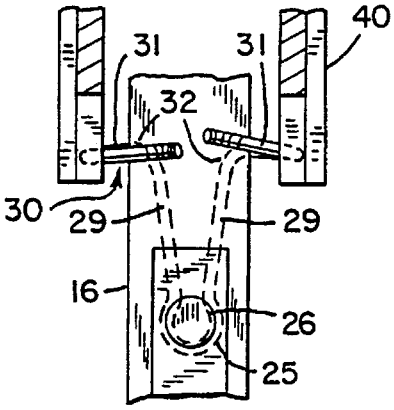
FIG. 7 is a view taken on line 7—7 of FIG. 6.
Figure 4:
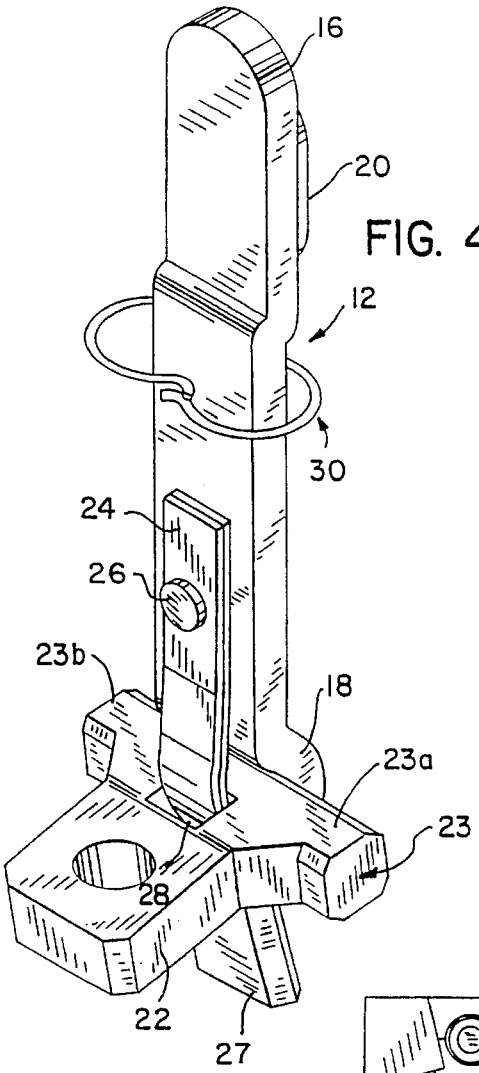
FIG. 4 is a perspective view of the load contact blade assembly.
Figure 5:
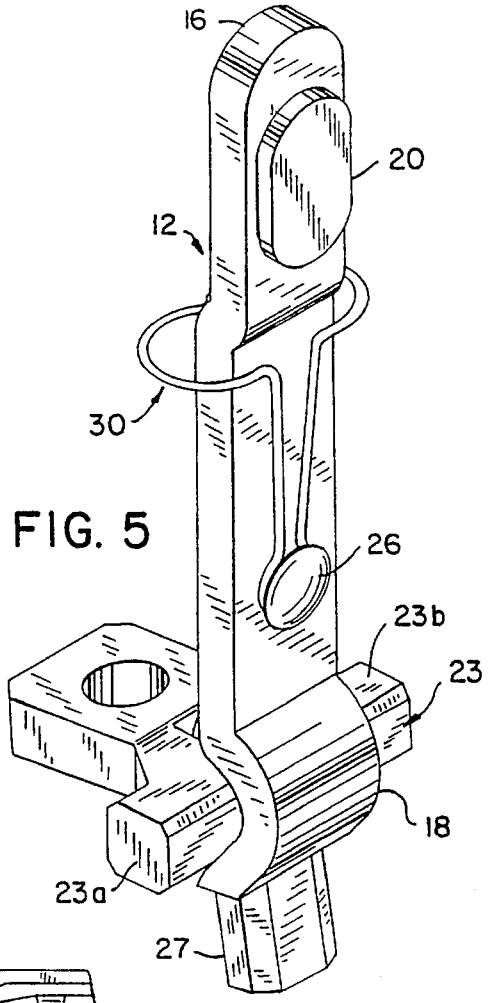
FIG. 5 is a perspective view of the load contact blade assembly.

A contact pressure wire spring 30 is mounted on the front of the load contact blade 12 by rivet 26 for leaf spring 24. Spring 30 as shown in FIGS. 6 and 7 includes a semi-circular loop 25 fixed to blade 16 by rivet 26. A pair of legs (i.e., beam spring portions) 29 are provided on the ends of loop 25 which diverge outwardly. A second semi-circular loop 31 is formed at the upper end of each of the legs 27. Loops 31 are bent at a right angle to the upper end of each leg 29. Loops 31 are biased outwardly by diverging legs 29 on loop 25.

A U-shaped channel member 40 is formed from a single piece of sheet steel or other ferrous material and includes a pair of side walls 42 extending outwardly from a base 44. A pair of opposed spring cam surface are provided by a surface 46 on the outer edges of each of side walls 42 extending at a predetermined angle (e.g. 25–65 degrees) from the parallel portion 46*a* of member 40. U-shaped member 40 is magnetically attracted to the loops 31 and blade 16 due to the magnetic field produced by the current in blade 16. This attraction delays the release of blade 16 and loops 31 from U-shaped channel member 40 until the arc between contacts 15 and 20 is extinguished. When the arc is extinguished and the blow apart forces subside, the return spring 35 will bias load contact blade assembly 12 to its original position.

In operation, loops 31 are initially in direct engagement with cam surfaces 46 when the load contact blade assembly 12 is in the closed position. The wire form spring 30, in combination with the return spring 35, and the interaction of piece 23, section 18 and leaf spring 24, holds the electric contact 20 on the load contact blade 16 in engagement with the electric contact 15 on the line contact blade 13 with an appropriate force. When the electromagnetic forces (i.e., blow apart) caused by the substantially parallel and opposite currents in blades 13 and 16 exceed a predetermined limit (i.e., during short circuit conditions), loops 31 slide along cam surfaces 46, are compressed and move to engage side walls 42 of U-shaped member 40. Upon engaging walls 42, the force loops 31 produce to restrict movement of blade 16 (i.e., counter-clockwise rotation) are greatly reduced to facilitate contact blow apart.

Although the invention has been described in conjunction with specific embodiments thereof, it is evident that alternatives, modifications and variations will be apparent to those skilled in the art. For example, the position of springs 30 and U-shaped channel member 40 could be reversed so that member 40 is fastened to arm 16 and spring 30 is fixed relative to base 17. It is intended to embrace all such alternatives, modifications and variations that fall within the spirit and broad scope of the appended claims.

What is claimed is:

1. A circuit breaker comprising:

a base;

a first contact arm moveable between first and second positions;

a second contact arm pivotally supported relative to the base to pivot within a plane about an axis perpendicular there to when forced from a closed position to an open position;

an operating mechanism supported by the base and coupled to one of the first and Second contact arms to cause movement thereof;

a first spring cam surface supported by the base, the first spring cam surface including a first surface substantially perpendicular to the axis and a second surface extending from the first surface at a predetermined angle; and a spring fastened to the second contact arm to engage the first surface when the second contact arm is in the open position and engage the second surface when the second contact arm is in the closed position, the spring applying force against both the first and second surfaces perpendicular to the plane within which the Second contact arm pivots, wherein the force required to move the contact arm from the closed position to the open position is higher when the spring is in contact with the second surface than when the spring is in contact with the first surface.

2. The circuit breaker of claim 1, further comprising a terminal strap supported by the base, wherein the second contact arm is pivotally attached to the terminal strap.

3. The circuit breaker of claim 2, further comprising a second spring cam surface supported by the base, the spring cam surface including a third surface substantially perpendicular to the axis and a fourth surface extending from the third surface at the predetermined angle, the spring simultaneously engaging the first and third surfaces and applying force against the third surface perpendicular to the plane within which the second contact arm pivots.

4. The circuit breaker of claim 3, wherein the first contact arm pivots when moving.

5. The circuit breaker of claim 4, wherein the first and second contact arms each includes an electric contact and the electric contacts are engageable to conduct electrical current therebetween when the second contact arm is in the closed position.

6. The circuit breaker of claim 3, wherein the spring includes a pair of legs connected to the second contact arm at one of their ends, and each leg includes a semi-circular loop at the other of their ends, one of the loops engaging the first spring cam surface and the other of the loops engaging the second spring cam surface.

7. A circuit breaker comprising:

a base;

a first contact arm moveable between first and second positions;

a second contact arm pivotally supported relative to the based to pivot within a plane about an axis perpendicular thereto when forced from a closed position to an open position;

an operating mechanism supported by the base and coupled to one of the first and second contact arms to cause movement thereof; and a multi-level force assembly coupled between the base and the second contact arm, the assembly including a first spring surface including a first surface substantially perpendicular to the axis and a second surface extending from the first surface at a predetermined angle, and a spring configured to engage the first surface when the second contact arm is in the open position and engage the second surface when the second contact arm is in the closed position, the spring applying force against both the first and second surfaces perpendicular to the plane within which the second contact arm pivots, wherein the force required to move the second contact arm from the closed position to the open position is higher when the spring is in contact with the second surface than when the spring is in contact with the first surface.

8. The circuit breaker of claim 7, wherein the first spring cam surface is mounted to the base, and the spring is fastened to the second contact arm.

9. The circuit breaker of claim 8, further comprising a terminal strap supported by the base, wherein the second contact arm is pivotally attached to the terminal strap.

10. The circuit breaker of claim 9, wherein the multi-level force assembly further comprises a second spring cam surface including a third surface substantially perpendicular to the axis and a fourth surface extending from the third surface at the predetermined angle, the spring simultaneously engaging the first and second surfaces and applying force against the third surface perpendicular to the plane within which the second contact arm pivots.

11. The circuit breaker of claim 10, wherein the first contact arm pivots when moving.

12. The circuit breaker of claim 8, wherein the first and second contact arms each includes an electric contact, and the electric contacts are engageable to conduct electrical current therebetween when the second contact arm is in the closed position.

13. The circuit breaker of claim 10, wherein the spring includes a pair of legs connected to the second contact arm at one of their ends, and each leg includes a semi-circular loop at the other of their ends, one of the loops engaging the first spring cam surface and the other of the loops engaging the second spring cam surface.

14. In a circuit breaker of the type including a semi-stationary contact arm biased to a closed position and forcible to an open position when rotated within a plane about an axis perpendicular thereto, a contact arm biasing assembly for biasing the contact arm to the closed position comprising;

a camming surface member including a first surface substantially perpendicular to the axis, a second surface substantially perpendicular to the axis, a third surface extending from the first surface at a predetermined angle and a fourth surface extending from the second surface at a predetermined angle; and a spring engaged within the first and second surfaces when the contact arm is in the open position and engaged with the third and fourth surfaces when the contact arm is in the closed position, the spring applying force against both the first and second surfaces perpendicular to the place within which the second contact arm pivots, wherein the force required to move the contact arm from the closed position to the open position is higher when the spring is in contact with the third and fourth surfaces than when the spring is in contact with the first and second surfaces.

15. The assembly of claim 14, wherein the spring includes a first semi-circular portion engageable with the first and third surfaces and a second semi-circular portion engageable with the second and fourth surfaces.

16. The assembly of claim 15, wherein the spring includes a first beam spring portion connected to the first semi-circular portion and a second beam spring portion connected to the second semicircular portion, the semi-circular portions lying within planes substantially perpendicular to the first and second beam spring portions.

17. The assembly of claim 16, wherein the first and second beam spring portions are connected, and the spring is fabricated from a single piece of spring wire.

18. The assembly of claim 17, wherein the spring includes a semi-circular loop between the first and second beam spring portions for fastening to the contact arm.

19. The assembly of claim 17, wherein the third and fourth surfaces diverge as they extend away from the first and second surfaces, respectively.

20. The assembly of claim 18, wherein the first and second semi-circular portions overlap when the portions are engaged with the first and second surfaces.

* * * * *